US009004020B2

(12) United States Patent
Mehring et al.

(10) Patent No.: US 9,004,020 B2
(45) Date of Patent: Apr. 14, 2015

(54) METHOD FOR WARMING AN INTERNAL COMBUSTION ENGINE, AND INTERNAL COMBUSTION ENGINE

(71) Applicant: Ford Global Technologies, LLC, Dearborn, MI (US)

(72) Inventors: Jan Mehring, Cologne (DE); Moritz Klaus Springer, Hagen (DE); Bernd Steiner, Bergisch Gladbach (DE); Thomas Lorenz, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 119 days.

(21) Appl. No.: 13/648,649

(22) Filed: Oct. 10, 2012

(65) Prior Publication Data

US 2013/0092108 A1 Apr. 18, 2013

(30) Foreign Application Priority Data

Oct. 17, 2011 (DE) ..... 10 2011 084 632

(51) Int. Cl.

| | |
|---|---|
| ***F02F 1/10*** | (2006.01) |
| ***F01P 3/00*** | (2006.01) |
| ***F01P 7/02*** | (2006.01) |
| ***F01M 5/00*** | (2006.01) |
| ***F01P 7/14*** | (2006.01) |

(52) U.S. Cl.

CPC *F01M 5/001* (2013.01); *F01P 7/14* (2013.01); *F01P 2003/006* (2013.01); *F01P 2037/02* (2013.01)

(58) Field of Classification Search

USPC ..... 123/41.01, 41.02, 41.04, 41.05, 41.44, 123/142.5 R, 142.5 E, 196 AB, 41.14, 41.42

See application file for complete search history.

(56) References Cited

U.S. PATENT DOCUMENTS

| | | | | |
|---|---|---|---|---|
| 2,788,773 | A * | 4/1957 | Meurer | 123/41.35 |
| 3,065,743 | A * | 11/1962 | Brehm et al. | 123/41.08 |
| 3,456,759 | A * | 7/1969 | Henry-Biabaud | 184/6 |
| 4,204,487 | A * | 5/1980 | Jones | 123/41.35 |
| 4,348,991 | A | 9/1982 | Stang et al. | |
| 4,393,824 | A * | 7/1983 | Fischer et al. | 123/196 AB |
| 4,667,630 | A * | 5/1987 | Sasaki | 123/254 |
| 4,813,408 | A * | 3/1989 | Katsumoto et al. | 123/196 AB |

(Continued)

FOREIGN PATENT DOCUMENTS

| | | |
|---|---|---|
| DE | 3620903 A1 | 12/1987 |
| DE | 3621352 A1 | 1/1988 |

(Continued)

*Primary Examiner* — M. McMahon
*Assistant Examiner* — Tea Holbrook
(74) *Attorney, Agent, or Firm* — Julia Voutyras; Alleman Hall McCoy Russell & Tuttle LLP

(57) ABSTRACT

The disclosure relates to a method for expediting warm up of an internal combustion engine cylinder block and engine oil utilizing an existing oil coolant circuit. A method for warming up an internal combustion engine with at least one cylinder, a cylinder block which is formed by an upper crankcase half mounted to a lower crankcase half, said lower crankcase half containing an oil sump which is fed, via a supply line, by a coolant jacket, an inlet side of said coolant jacket supplied in turn with oil via the oil sump by an oil pump, the method comprising: releasing oil from the coolant jacket via gravity to reduce a cooling capacity of the internal combustion engine.

9 Claims, 5 Drawing Sheets

(56) References Cited

U.S. PATENT DOCUMENTS

| | | | | |
|---|---|---|---|---|
| 5,050,936 | A * | 9/1991 | Tanaka et al. | 303/3 |
| 5,339,776 | A * | 8/1994 | Regueiro | 123/196 CP |
| 5,819,692 | A * | 10/1998 | Schafer | 123/41.35 |
| 6,750,763 | B2 * | 6/2004 | Ismail et al. | 340/450.3 |
| 6,938,605 | B2 * | 9/2005 | Al-Khateeb | 123/196 AB |
| 6,941,922 | B2 * | 9/2005 | Williams et al. | 123/196 R |
| 7,370,612 | B2 * | 5/2008 | Hanai | 123/41.14 |
| 7,819,093 | B2 * | 10/2010 | Yamashita et al. | 123/41.35 |
| 7,886,705 | B2 * | 2/2011 | Holler et al. | 123/142.5 R |
| 8,186,327 | B2 * | 5/2012 | Ni | 123/196 CP |
| 8,291,882 | B2 * | 10/2012 | Sugiura | 123/196 R |
| 8,402,929 | B2 * | 3/2013 | Marsh et al. | 123/41.02 |
| 8,464,963 | B2 * | 6/2013 | Roth et al. | 237/12.3 B |
| 2002/0073942 | A1 * | 6/2002 | Hollis | 123/41.44 |
| 2003/0089319 | A1 * | 5/2003 | Duvinage et al. | 123/41.02 |
| 2006/0130817 | A1 * | 6/2006 | Gonze et al. | 123/520 |
| 2007/0084427 | A1 * | 4/2007 | Petrosius et al. | 123/142.5 E |
| 2009/0205590 | A1 * | 8/2009 | Vetrovec | 123/41.14 |
| 2009/0241866 | A1 * | 10/2009 | Sugiura | 123/41.56 |
| 2009/0241872 | A1 * | 10/2009 | Wang et al. | 123/90.11 |
| 2009/0281779 | A1 * | 11/2009 | Kajitani et al. | 703/7 |
| 2010/0058848 | A1 * | 3/2010 | Hamama et al. | 73/114.68 |
| 2011/0197832 | A1 * | 8/2011 | Berkemeier et al. | 123/41.44 |
| 2011/0214627 | A1 * | 9/2011 | Nishikawa et al. | 123/41.02 |
| 2011/0253092 | A1 * | 10/2011 | Springer et al. | 123/196 R |
| 2012/0048228 | A1 * | 3/2012 | Chung | 123/196 R |
| 2012/0048504 | A1 * | 3/2012 | Park et al. | 165/41 |
| 2012/0118248 | A1 | 5/2012 | Mehring et al. | |
| 2012/0285401 | A1 * | 11/2012 | Quiring et al. | 123/41.08 |
| 2012/0285413 | A1 * | 11/2012 | Pingen et al. | 123/196 AB |

FOREIGN PATENT DOCUMENTS

| | | | |
|---|---|---|---|
| DE | 3701385 | C1 | 2/1988 |
| DE | 3843827 | A1 | 7/1990 |
| DE | 19940144 | A1 | 3/2001 |
| JP | 2006105023 | A * | 4/2006 |

* cited by examiner

METHOD FOR WARMING AN INTERNAL COMBUSTION ENGINE, AND INTERNAL COMBUSTION ENGINE

PRIORITY CLAIM

The present application claims priority to German Patent Application No. 102011084632.8, filed on Oct. 17, 2011, the entire contents of which are hereby incorporated by reference for all purposes.

TECHNICAL FIELD

The disclosure relates to a method for warming up an internal combustion engine using an existing oil circuit.

BACKGROUND AND SUMMARY

Internal combustion engines have a cylinder head and a cylinder block, which are connected to one another at the assembly faces thereof to form the individual cylinders, i.e. combustion chambers. The cylinder head is often used to accommodate the valve gear. The purpose of the valve gear is to open and close the intake and exhaust ports of the combustion chamber at the right times.

To accommodate the pistons and the cylinder liners, the cylinder block has a corresponding number of cylinder bores. The piston of each cylinder of an internal combustion engine is guided in a cylinder liner in a manner which allows axial movement and, together with the cylinder liner and the cylinder head, the piston delimits the combustion chamber of a cylinder. In this arrangement, the piston head forms part of the inner wall of the combustion chamber and, together with the piston rings, seals off the combustion chamber with respect to the cylinder block and the crankcase, thus preventing any combustion gases or any combustion air from entering the crankcase and preventing any oil from entering the combustion chamber.

The piston serves to transmit the gas forces generated by combustion to the crankshaft. For this purpose, the piston is connected in an articulated manner, by means of a gudgeon pin, to a connecting rod, which, in turn, is mounted movably on the crankshaft. The crankshaft, which is mounted in the crankcase, absorbs the connecting rod forces resulting from the gas forces due to fuel combustion in the combustion chamber and the inertia forces due to the non-uniform movement of the components of the power plant. The oscillating stroke motion of the pistons is transformed into a rotating rotary motion of the crankshaft. In this motion, the crankshaft transmits the torque to the drive train. Some of the energy transmitted to the crankshaft is used to drive auxiliary units, such as the oil pump and the generator, or serves to drive the camshaft and hence to actuate the valve gear.

In general and in the context of the present disclosure, the upper crankcase half is formed by the cylinder block. The crankcase is completed by the lower crankcase half, which can be mounted on the upper crankcase half and serves as an oil sump. The upper crankcase half has a flange surface to receive the oil sump, i.e. the lower crankcase half. In general, a seal is provided in or on the flange surface in order to seal off the oil sump or crankcase with respect to the surroundings. The connection is often made by means of a bolted joint.

To receive and support the crankshaft, at least two bearings are provided in the crankcase, generally being embodied in two parts and each comprising a bearing saddle and a bearing cover that can be connected to the bearing saddle. The crankshaft is supported in the region of the crankshaft journals, which are arranged, spaced apart along the crankshaft axis and are generally designed as thickened shaft offsets. The bearing covers and the bearing saddles can be designed as separate components or can be formed integrally with the crankcase, i.e. the crankcase halves. Bearing shells can be arranged as intermediate elements between the crankshaft and the bearings.

In the assembled state, each bearing saddle is connected to the corresponding bearing cover. One bearing saddle and one bearing cover in each case—if appropriate in conjunction with bearing shells as intermediate elements—form a bore for receiving a crankshaft journal.

The bores are generally supplied with engine oil, i.e. lubricating oil, and therefore, ideally, there is a load bearing lubricating film formed between the inner surface of each bore and the associated crankshaft journal as the crankshaft rotates, as in a plain bearing. As an alternative, it is also possible for a bearing to be of one-piece design, e.g. in the case of a built-up crankshaft.

To supply the bearings with oil, a pump for delivering engine oil to the at least two bearings is provided, and, via an oil circuit, the pump supplies engine oil to a main oil gallery, from which passages lead to the at least two bearings. To form the main oil gallery, a main supply passage is often provided in the cylinder block and is aligned along the longitudinal axis of the crankshaft.

According to previous systems, the pump is supplied with engine oil stemming from an oil sump via an intake line, which leads from the oil sump to the pump, and may ensure a sufficiently large delivery flow, i.e. a sufficiently large delivery volume, and may ensure a sufficiently high oil pressure in the supply system, i.e. in the oil circuit, in particular in the main oil gallery.

Another possible consuming unit in the abovementioned sense which requires an oil supply is the camshaft holder, for example. The explanations given already in respect of the support of the camshaft apply analogously. The camshaft holder is also generally supplied with lubricating oil, for which purpose a supply passage has to be provided.

Other possible consuming units are, for example, the bearings of a connecting rod or of a balancer shaft, where provided. An oil spray cooling system is likewise a consuming unit in the abovementioned sense, wetting the piston head with engine oil from below, i.e. from the crankcase side, by means of nozzles for the purpose of cooling and thus requiring oil, i.e. requiring a supply of oil. A hydraulically actuated camshaft adjuster or other valve gear components, e.g. those for hydraulic valve lash compensation, likewise have a requirement for engine oil and require an oil supply. An oil filter, or oil cooler provided in the supply line is not a consuming unit in the aforementioned sense. Admittedly, these components of the oil circuit are also supplied with engine oil. By its very nature, however, an oil circuit entails the use of these components, which have only tasks, i.e. functions, which relate to the oil as such. It is only a consuming unit which renders the oil circuit necessary.

The friction in the consuming units to be supplied with oil, e.g. the bearings of the crankshaft or between the piston and the cylinder liner, depends on the viscosity and hence the temperature of the oil provided and contributes to the fuel consumption of the internal combustion engine. Fundamentally, the aim is to minimize fuel consumption. In addition to improved, e.g. more effective, combustion, reducing the friction power is among the foremost aims. Moreover, reduced fuel consumption also contributes to a reduction in pollutant emissions.

With respect to reducing the friction power, rapid warming of the engine oil and rapid heating of the internal combustion engine are helpful, especially after a cold start. Rapid warming up of the engine oil during the warm-up phase of the internal combustion engine ensures that there is a correspondingly rapid decrease in viscosity and hence a reduction in friction or friction power. Previous systems include concepts in which the oil is warmed up actively by means of an external heating device. However, the heating device is an additional consuming unit in respect of fuel use, and this runs counter to the aim of reducing fuel consumption.

Other concepts envisage storing the engine oil warmed up during operation in an insulated container and using it when required, e.g. when restarting the internal combustion engine. The disadvantage with this procedure is that the oil warmed up during operation cannot be kept indefinitely at a high temperature, for which reason it is generally useful to warm up the oil again during the operation of the internal combustion engine.

Both an external heating device and an insulated container lead to an additional installation space requirement in the engine compartment and are detrimental to maximum-density packaging of the drive unit.

Reducing the friction power by rapid warming up of the engine oil is also made more difficult by the fact that the cylinder block or cylinder head are thermally highly stressed components which require effective cooling and are therefore often fitted with coolant jackets to form a liquid cooling system. The thermal economy of a liquid cooled internal combustion engine is governed primarily by this cooling system. The cooling system is designed with a view to protection from overheating and not with a view to warming up the engine oil as quickly as possible after a cold start.

Fitting the internal combustion engine with a liquid cooling system requires the arrangement of coolant passages which carry the coolant through the cylinder head and/or the cylinder block, i.e. at least one coolant jacket. The coolant, in general water containing additives, is delivered by means of a pump arranged in the cooling circuit, with the result that it circulates in the coolant jacket. In this way, the heat released to the coolant is dissipated from the interior of the cylinder block or cylinder head and, in general, is removed from the coolant again in a heat exchanger.

Compared with other coolants, water has the advantage that it is non-toxic, easily available and inexpensive and furthermore has a very high heat capacity, for which reason water is suitable for removing and carrying away very large quantities of heat, and this is generally seen as an advantage. On the other hand, the corrosion associated with water of the components supplied with coolant, and the comparatively low maximum permissible coolant temperature of about 95° C., which is a co-determinant of the temperature difference between the coolant and the components to be cooled and hence of the heat transfer, are disadvantageous.

If the intention is to remove less heat from the internal combustion engine, in particular the cylinder block, the use of other cooling fluids, e.g. oil, may be expedient. Oil has a lower heat capacity than water and can be heated up further, i.e. to higher temperatures, thereby making it possible to reduce the cooling capacity. The problem of corrosion is eliminated. Oil can be allowed to come into contact with components, especially moving components, without putting at risk the ability to function of the internal combustion engine.

An oil-cooled internal combustion engine is described by German Laid-Open Application DE 199 40 144 A1, for example. Moreover, the use of oil as a coolant for the cooling circuit has further advantages, in particular the advantage that an oil cooling system and the associated coolant jackets can be formed together with the oil supply system of the internal combustion engine, i.e. a common, coherent oil circuit is formed. After a cold start, the oil is warmed up more quickly owing to the fact that it flows through the at least one coolant jacket, thereby making it possible to shorten the warm-up phase.

However, the inventors herein have recognized an issue with the above approach. Routing oil through the cylinder block coolant jacket delays the warm-up of the cylinder block following an engine cold start, reducing the temperature of the exhaust produced in the engine and delaying light-off of downstream aftertreatment devices.

Accordingly, a method for warming up an internal combustion engine with at least one cylinder, a cylinder block which is formed by an upper crankcase half mounted to a lower crankcase half, said lower crankcase half containing an oil sump which is fed, via a supply line, by a coolant jacket, an inlet side of said coolant jacket supplied in turn with oil via the oil sump by an oil pump is provided. In one example, the method comprises releasing oil from the coolant jacket via gravity to reduce a cooling capacity of the internal combustion engine.

In this way, the cylinder block can be rapidly heated. This method of warming the block does not require additional heating units or insulated oil storage, although such additional units or stage may be used, if desired. Increasing the speed at which the cylinder block is heated is advantageous for operating conditions of the engine as well as for the use of accessories within the vehicle including cabin heat.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
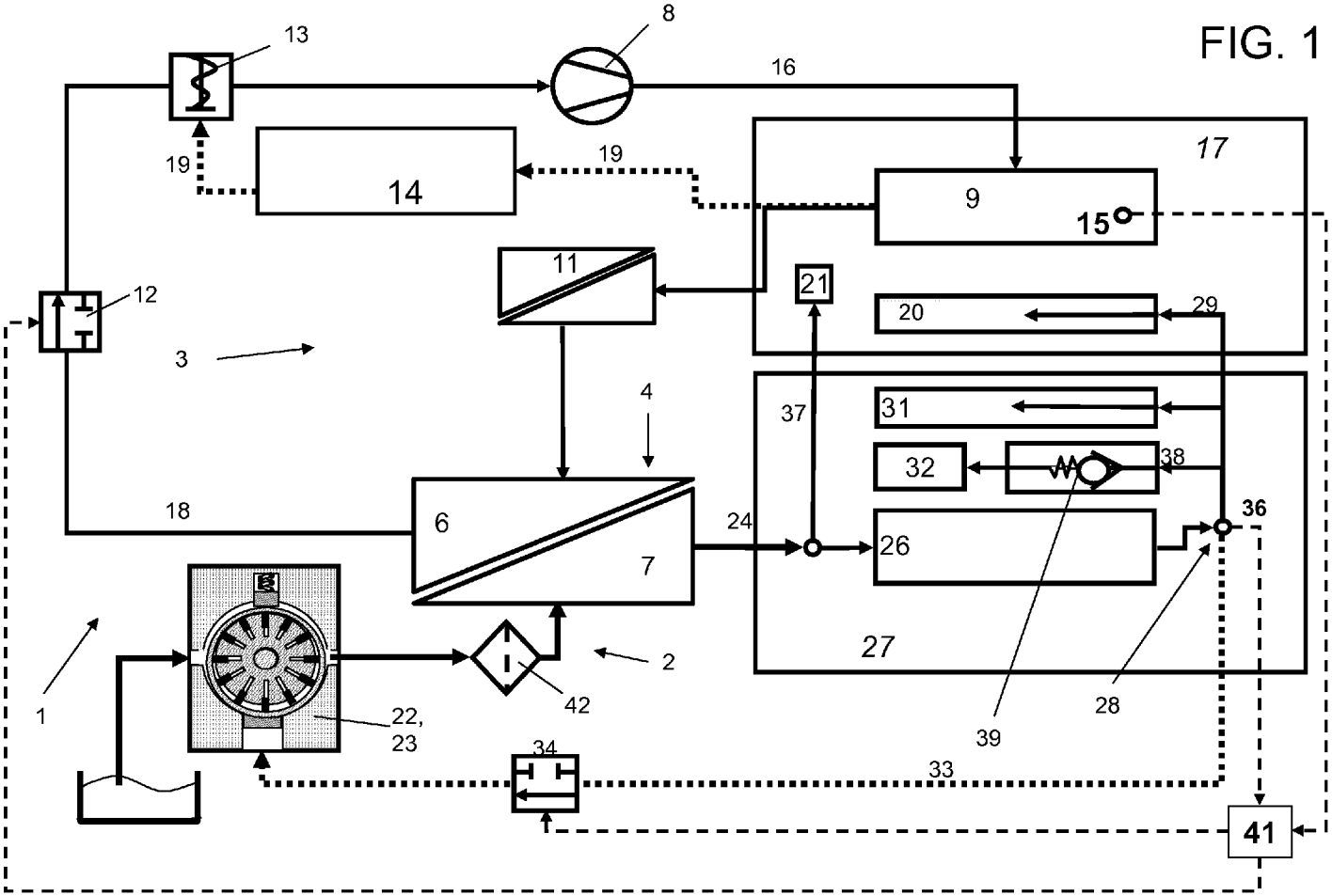
FIG. 1 shows a hybrid coolant circuit of an internal combustion engine.

In the context of the present disclosure, the term "internal combustion engine" includes not only diesel engines and spark ignition engines but also hybrid internal combustion engines, i.e. internal combustion engines which are operated by a hybrid combustion method.

The internal combustion engine which forms the subject matter of the present disclosure also has an oil cooling system which forms a common oil circuit with the oil supply system. To form the oil cooling system, the cylinder block serving as an upper crankcase half is fitted with at least one integrated coolant jacket. The internal combustion engine of the present disclosure includes: at least one cylinder; a cylinder block, which serves as an upper crankcase half and, in order to form an oil cooling system, has at least one integrated coolant jacket; and an oil sump for the purpose of collecting oil, which can be mounted on the upper crankcase half and serves as a lower crankcase half. The at least one coolant jacket is connected on the inlet side, via a supply line, to a pump for delivering oil stemming from the oil sump, and is connected on the outlet side, via a return line, to the oil sump in order to form an oil circuit. At least some of the oil is released from the at least one coolant jacket of the cylinder block by means of at least one line, using the force of gravity, in order to reduce the quantity of oil in the at least one coolant jacket and hence to reduce the cooling capacity.

In one embodiment, the method according to the disclosure for warming up an internal combustion engine uses a common service fluid or cooling fluid, such as oil, and is therefore not distinguished by a special coolant with modified material properties. Moreover, there is no use of additional units for warming up the oil, as proposed in previous systems, said units requiring energy and taking up installation space, nor is the engine oil warmed up during operation stored in an insulated container and used when required. On the contrary, in the method according to the disclosure, the oil quantity in the at least one coolant jacket is varied in order to influence the quantity of heat removed from the cylinder block. Here, the cooling capacity is reduced by releasing at least some of the oil. Owing to the reduced cooling capacity and the resulting reduction in heat dissipation, the cylinder block heats up more quickly in the warm-up phase. Resultantly, residual oil in the coolant jacket and other oil consumers also warms up more readily. This is advantageous as the viscosity of the oil changes responsive to temperature and is a co-determinant of the friction between the piston and the cylinder liner.

Here, the method according to the disclosure makes use of the fact that the internal combustion engine or the associated cylinder block is fitted with an oil cooling system which forms a common oil circuit with the oil supply system of the internal combustion engine. Thus, the oil from the cooling system can be released from the cylinder block into the oil sump of the oil supply system.

In one embodiment, the method according to the disclosure requires an open circuit which, in the present case, is formed in part by the oil supply system of the internal combustion engine but, for example, could not be formed by a water cooling system, which is frequently used with internal combustion engines. If there were a desire to apply the concept according to the disclosure to a water cooled internal combustion engine, a removal point for release of the water, a storage container, a delivery pump and the like would have to be provided. It should be noted that, in principle, the cylinder head can be water cooled or can be part of the oil cooling system. The above-described substantive embodiment of the internal combustion engine in conjunction with the use of oil as a coolant allows release of the cooling fluid.

By virtue of the principle involved, releasing oil not only influences or reduces the quantity of coolant in the at least one coolant jacket but also influences or reduces the heat transfer area between the oil and the block. The possibility of releasing oil in the liquid cooling system from the cylinder block allows cooling of the block as required.

In the cooling system according to the disclosure too, the pumping capacity and hence also the coolant throughput, i.e. the delivery volume, can be adjusted. This makes it possible to influence the flow rate, which is a co-determinant of heat transfer by convection. In this way, a greater or lesser quantity of heat can be removed from the cylinder block.

The release of oil in accordance with the disclosure should be distinguished from discharging oil via a return line into the oil sump, wherein the quantity of oil in the at least one coolant jacket does not change or should not change since the quantity of oil returned is continuously replaced by oil which is fed in via the supply line.

The method according to the disclosure is particularly advantageous during the warm-up phase, especially after a cold start. After the vehicle has been stationary, i.e. when the internal combustion engine is restarted, the coolant level or quantity of oil in the cylinder block is preferably at a minimum. Owing to the combustion processes which are taking place, the cylinder block warms up relatively quickly, as a result of which relatively large quantities of heat are already being introduced into the oil in the cylinder block immediately after starting. Consequently, the oil made available to the consuming units is warmed up more quickly and has the low viscosity required for a lower friction power more quickly. As a result, there is a noticeable reduction in the fuel consumption of the internal combustion engine.

Embodiments of the method are advantageous in which the quantity of heat removed from the cylinder block by means of oil cooling is controlled at least in part by the release of oil. This variation takes account of the fact that the cooling capacity, i.e. the quantity of heat removed from the block, can not only be reduced by releasing some of the oil but can fundamentally be controlled by varying the quantity of oil in the cylinder block. This allows cooling of the block as required.

Embodiments of the method in which the oil released is directed into the oil sump are advantageous. The oil sump of the oil supply system is used to collect and store oil and has the required volume to enable even relatively large quantities or all of the oil to be released from the block. Moreover, the oil sump serves as a heat exchanger for reducing the oil temperature once the internal combustion engine has warmed up, and the oil which has been released into the oil sump can also cool down. The oil in the oil sump is cooled by heat conduction and convection by means of an air flow guided past the outside.

Embodiments of the method in which the supply line is used as a line for releasing oil under the force of gravity are advantageous. This variant is distinguished by the fact that an already existing line is used for release. This is advantageous in respect of costs and of the installation space required. In the installed position, the pump of the oil circuit should be arranged below the inlet of the supply line into the coolant jacket. Moreover, the release of oil via the supply line requires that the supply line should have a gradient which permits or assists the gravity oil feed.

However, embodiments of the method in which at least one additional line is used to release oil under the force of gravity, wherein this additional line is connected to the at least one integrated coolant jacket, are also advantageous. An additional line can be designed specifically for the release of oil under the force of gravity, being aligned in the direction of gravitational acceleration for example. Such a line allows more freedom in design configuration than an already existing line, which is designed primarily for a different function. In the context of the description of the internal combustion engine, various embodiments of the additional line are explained.

Embodiments of the method in which at least some of the oil is released after the internal combustion engine is switched off in order to reduce the cooling capacity of the oil cooling system when the internal combustion engine is restarted and hence to shorten the warm-up phase of the internal combustion engine are advantageous.

Rapid heating of the internal combustion engine is advantageous, especially after a cold start, and ensures a correspondingly rapid reduction in friction or friction power. In the present case, this rapid heating is achieved by the fact that at least some of the oil, preferably the maximum possible quantity of oil, is released after the internal combustion engine is switched off. This ensures that the cooling capacity of the oil cooling system is low or minimal when the internal combustion engine is restarted.

If oil is released in order to reduce the cooling capacity, i.e. the quantity of oil in the coolant jacket of the block is reduced, it may be helpful to prevent the delivery of oil through the coolant jacket, even if this delivery comprises both supplying oil via the supply line and the discharging of oil via the return line.

Embodiments of the method in which oil is released continuously, such that the pump delivers oil into the at least one coolant jacket if there is a cooling requirement, in order to compensate for the quantity of oil released, are advantageous. The internal combustion engine for carrying out this variant of the method has a continuously open line for releasing oil, and therefore additional shutoff elements in the line for controlling the quantity of oil discharged are dispensed with. If there is a requirement for cooling that necessitates a larger quantity of oil in the block, oil may be delivered into the at least one coolant jacket by means of the pump in order to at least compensate for the quantity of oil released.

Embodiments of the internal combustion engine in which the at least one line is connected to the oil sump are advantageous. Also advantageous are embodiments of the internal combustion engine in which a line for releasing oil under the force of gravity is the supply line. The reasons are those stated above in connection with the description of the method.

Embodiments of the internal combustion engine in which at least one additional line for releasing oil under the force of gravity is provided, wherein this additional line is connected in such a way to the at least one integrated coolant jacket that at least half of the coolant jacket volume can be emptied in the installed position of the internal combustion engine, are advantageous. Thus, the additional line can be aligned substantially vertically, i.e. in the direction of gravitational acceleration, and the connection of the line to the coolant jacket can be chosen with a view to a predetermined maximum quantity of oil to be released. According to the embodiment under consideration, the line is configured in such a way that at least half of the coolant jacket volume can be emptied.

Embodiments of the internal combustion engine in which at least three quarters of the coolant jacket volume can be emptied in the installed position of the internal combustion engine are also advantageous. For complete emptying of the coolant jacket, it is also possible for the line to branch off at the base of the jacket or to branch off from the coolant jacket at lowest point.

On internal combustion engines on which at least one additional line for releasing oil under the force of gravity is provided, embodiments of the internal combustion engine wherein a shutoff element is arranged in the at least one additional line are advantageous. Embodiments in which the shutoff element can be controlled electronically, hydraulically, pneumatically, mechanically or magnetically, preferably by means of an engine controller, are advantageous. In particular, a check valve or a solenoid valve that is electronically controlled by means of an engine controller can be used as a shutoff element.

Also advantageous in the case of internal combustion engines on which at least one additional line for releasing oil under the force of gravity is provided are embodiments wherein the at least one additional line is a permanently open line, which has a diameter D of D<3 mm. In this context, embodiments of the internal combustion engine in which the at least one additional line is a permanently open line which has a diameter D of D<2 mm, preferably of D<1.5 mm.

In the present case, a shutoff element is dispensed with. Instead, the diameter of the line is dimensioned in such a way, that the line is self-governing. The amount of oil which is released via the permanently open line depends not only on the geometric dimensioning but also on the viscosity and hence on the temperature of the oil. The hot oil of an internal combustion engine that is warm from operation runs off more quickly owing to the low viscosity. This is advantageous in respect of rapid release of the oil after the internal combustion engine is switched off. Cold oil, on the other hand, runs off slowly, if at all, owing to the high viscosity. This is advantageous if there is a cooling requirement and cold oil is delivered from the oil sump into the coolant jacket of the cylinder block by means of a pump.

The method of the present disclosure can be carried out in an engine containing a hybrid cooling system, such as that shown in FIG. 1. Turning to FIG. 1, the drawing shows a hybrid cooling system 1 of an internal combustion engine, which hybrid cooling system has at least two cooling circuits 2, 3, of which a block cooling circuit 2 is traversed by engine oil and a head cooling circuit 3 is traversed by a liquid cooling medium, the two cooling circuits 2, 3 having a common heat exchanger 4.

The cooling medium of the head cooling circuit 3 is, for example, a water-glycol mixture. The heat exchanger 4 has a so-called water side 6 and a so-called oil side 7. The head cooling circuit 3 is connected to the water side 6 of the heat exchanger 4, with the block cooling circuit 2 being connected to the oil side 7 thereof. No exchange of cooling media takes place in the heat exchanger. The cooling medium of the head cooling circuit 3 will be referred to hereinafter as coolant.

The head cooling circuit 3 also has a pump 8, a head cooling jacket 9, a cabin heat exchanger 11, a shut-off valve 12, a thermostat 13 and a main cooler 14, wherein further components are not illustrated.

In one embodiment, the shut-off valve 12 serves as a way for preventing a coolant flow in the head cooling circuit 3. A coolant flow with a magnitude of zero may also be attained by virtue of the pump 8 being switched off. It is also possible for a bypass line to be provided which bypasses the heat exchanger 4 at the water side in order thereby to prevent a heat transfer.

Proceeding from the pump 8, a connecting line 16 opens out in the cooling jacket 9 of the cylinder head 17. The coolant flows through the head-side coolant jacket 9 and flows into the cabin heat exchanger 11, and from here into the water side 6 of the heat exchanger 4, that is to say of the oil-water heat exchanger 4.

A return line 18 leads from the water side 6 of the heat exchanger 4 back to the pump 8. The shut-off valve 12 is arranged in the return line 18, wherein the thermostat 13 is arranged in the return line 18 downstream of the shut-off valve 12 and upstream of the pump 8. A cooler line 19, in which the main cooler 14 is arranged, branches off upstream of the cabin heat exchanger 11. The cooler line 19 opens out, downstream of the main cooler 14, in the thermostat 13.

While the thermostat 13 is arranged in the return line 18, in embodiments described herein, the thermostat does not block coolant flow through the return line 18 from the shut-off valve 12 but rather allows the coolant to flow in this direction. The thermostat 13 may be configured to block coolant flow from the cooler 14, based on the temperature of the coolant in the cooler line 19.

A sensor for measuring the coolant temperature is arranged in the head cooling circuit 3. The sensor is illustrated diagrammatically as a solid circle 15. The sensor is arranged preferably in the head cooling jacket 9 in order to measure an actual coolant temperature. It is possible for yet a further sensor to be provided which measures the inlet-side coolant temperature. In this respect, the further sensor could be arranged directly at the outlet of the pump 8 or at a suitable point of the connecting line 16.

Also shown in the cylinder head 17 are a diagrammatically illustrated bearing point 20 and diagrammatic hydraulic control elements, or hydraulic actuating elements, 21.

A delivery device 22 designed preferably as a variable pump 23 is provided in the block cooling circuit 2 illustrated in FIG. 1. Here, the block cooling circuit 2 opens out, downstream of the delivery device 22 via oil filter 42, into the oil side 7 of the heat exchanger 4. Downstream of the heat exchanger 4, a connecting line 24 leading from the heat exchanger 4 or from the oil side 7 thereof opens out in the cooling jacket 26 of the cylinder block 27. From the latter, the coolant or the engine oil passes, having undergone a change in temperature (the oil absorbs heat, and thus cools the cylinder block 27), to a junction 28 from which connecting lines 29 lead to bearing points 31 in the cylinder block 27 and also in the cylinder head 17 (bearing point 20). Furthermore, the engine oil may also be supplied, proceeding from the junction 28, to piston cooling devices or piston spray nozzles 32. Also branching off from the junction 28 is the control line 33 in which a control element 34 is arranged. Downstream of the control element 34, the control line 33 opens out at a corresponding inlet of the delivery device 22.

As illustrated by way of example, a temperature sensor 36 is arranged at the junction 28 in order to measure the oil temperature at the outlet side of the cylinder block 27. The temperature sensor 36 is again illustrated as a solid circle.

Upstream of the block cooling jacket 26 there is provided a branch 37 to the hydraulic control elements 21. A check valve 39 is also arranged in the piston cooling line 38 to the piston spray nozzles 32. The illustrated lines may be formed as ducts.

FIG. 1 illustrates in each case only the pressurized lines in the cylinder block 27 and also in the cylinder head 17, wherein corresponding return lines have not been illustrated.

The temperature values of the coolant and of the oil measured by the sensors are transmitted to a control unit 41. This may take place wirelessly or by wire.

Limit values with regard to predefined limit values or threshold temperature values with regard to the oil temperature and the coolant temperature are stored in the control unit 41. The control unit 41 is connected to the control element 34 and to the shut-off valve 12 in order to transmit control signals to these, which may likewise be realized wirelessly or by wire.

A comparison of the actual measured temperatures with predefined temperature limit values, that is to say threshold temperature values, may be carried out in the control unit 41 in order thereby to correspondingly switch the shut-off valve 12 and/or the control element 34 in the control line 33.

It is expedient if, in a first phase of a warm-up phase of the internal combustion engine, the shut-off valve 12 is closed, with the control element 34 being opened. A volume flow in the head cooling circuit 3 can thus be prevented, with a small oil volume flow circulating in the block cooling circuit 2, specifically under pressure through the block cooling jacket 26 to the bearing points 31 and 20 and back again via unpressurized return lines (not illustrated).

An engine containing such a hybrid cooling system is appropriate in the present disclosure as the differing cooling system for cylinder head and cylinder block (shown in FIG. 2) allow for more intricate control of cooling needs for different systems. This increased control and allowance for differential cooling needs for cylinder block and head is preferred in the present disclosure as the method providing for rapid warming of the cylinder block need not affect the cooling system of the cylinder head. A hybrid cooling system is, however, not required to carry out the present disclosure. A single coolant system which also utilizes oil to cool the cylinder head is compatible with the present disclosure.

Figure 2:
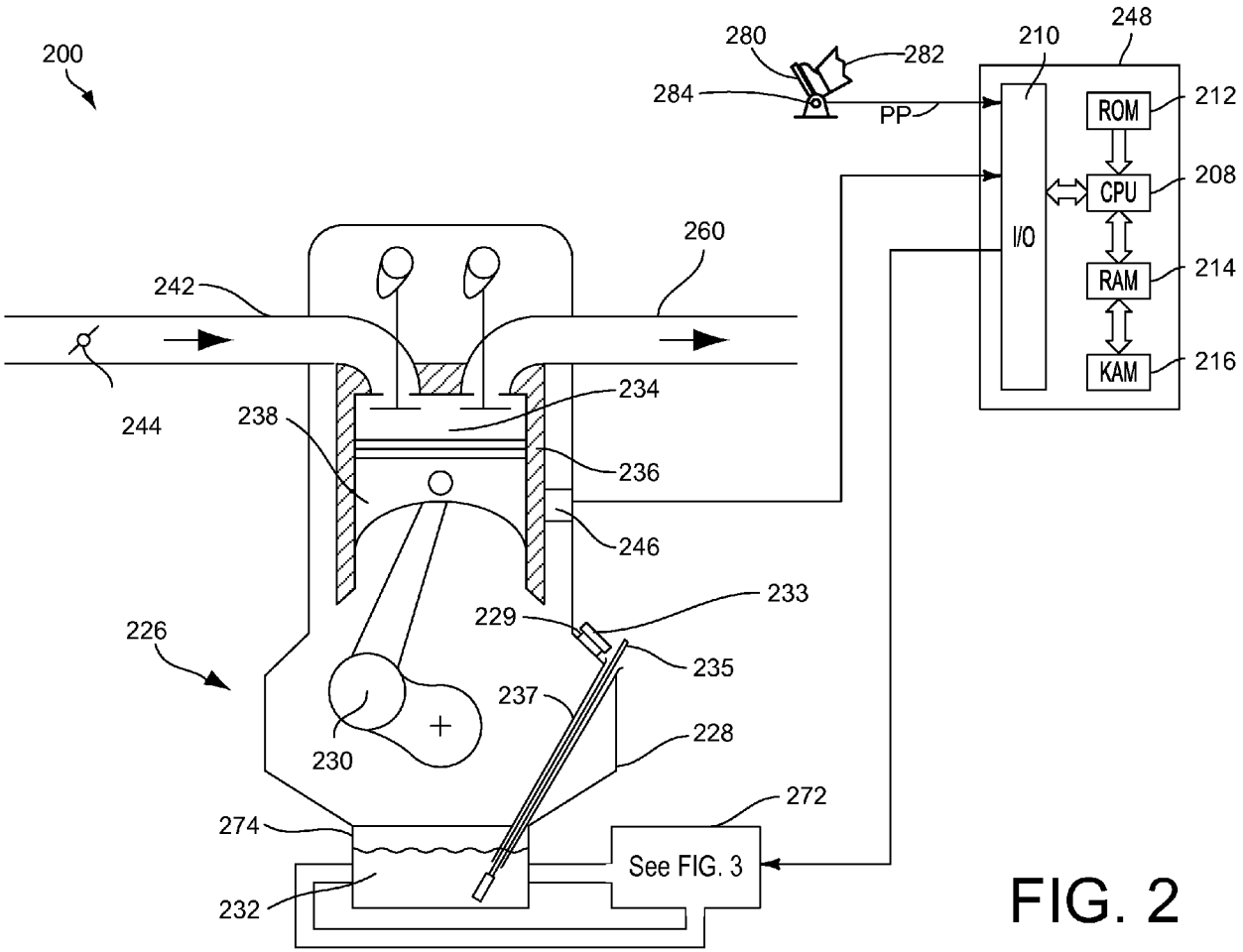
FIG. 2 shows a partial engine view according to an embodiment of the present disclosure.

Referring now to FIG. 2, it shows an example system configuration of a multi-cylinder engine, generally depicted at 200, which may be included in a propulsion system of an automobile. Engine 200 may be controlled at least partially by a control system including controller 248 and by input from a vehicle operator 282 via an input device 280. In this example, input device 280 includes an accelerator pedal and a pedal position sensor 284 for generating a proportional pedal position signal PP.

Engine 200 may include a lower portion of the engine block, indicated generally at 226, which may include an upper crankcase half 228 encasing a crankshaft 230. Upper crankcase half 228 is connected to lower crankcase half 274 which includes an oil sump 232, otherwise referred to as an oil well, holding engine lubricant (e.g., oil) positioned below the crankshaft. An oil fill port 229 may be disposed in upper crankcase half 228 so that oil may be supplied to oil sump 232. Oil fill port 229 may include an oil cap 233 to seal oil port 229 when the engine is in operation. A dip stick tube 237 may also be disposed in upper crankcase half 228 and may include a dipstick 235 for measuring a level of oil in oil sump 232.

The upper portion of engine block 226 may include a combustion chamber (i.e., cylinder) 234. The combustion chamber 234 may include combustion chamber walls 236 with piston 238 positioned therein. Piston 238 may be coupled to crankshaft 230 so that reciprocating motion of the piston is translated into rotational motion of the crankshaft. Combustion chamber 234 may receive fuel from fuel injectors (not shown) and intake air from intake manifold 242 which is positioned downstream of throttle 244. The engine block 226 may also include a coolant temperature sensor 246 input into an engine controller 248 (described in more detail below herein). Exhaust combustion gases exit the combustion chamber 234 via exhaust passage 260.

Controller 248 is shown in FIG. 2 as a microcomputer, including microprocessor unit 208, input/output ports 210, an electronic storage medium for executable programs and calibration values shown as read only memory chip 212 in this particular example, random access memory 214, keep alive memory 216, and a data bus. Controller 248 may receive various signals from various sensors coupled to engine 200 including coolant temperature from temperature sensor 246. In turn, controller 248 can signal via input/output ports 210 to valves described in FIG. 3 contained within oil circuit 272 that encompasses oil sump 232.

Figure 3:
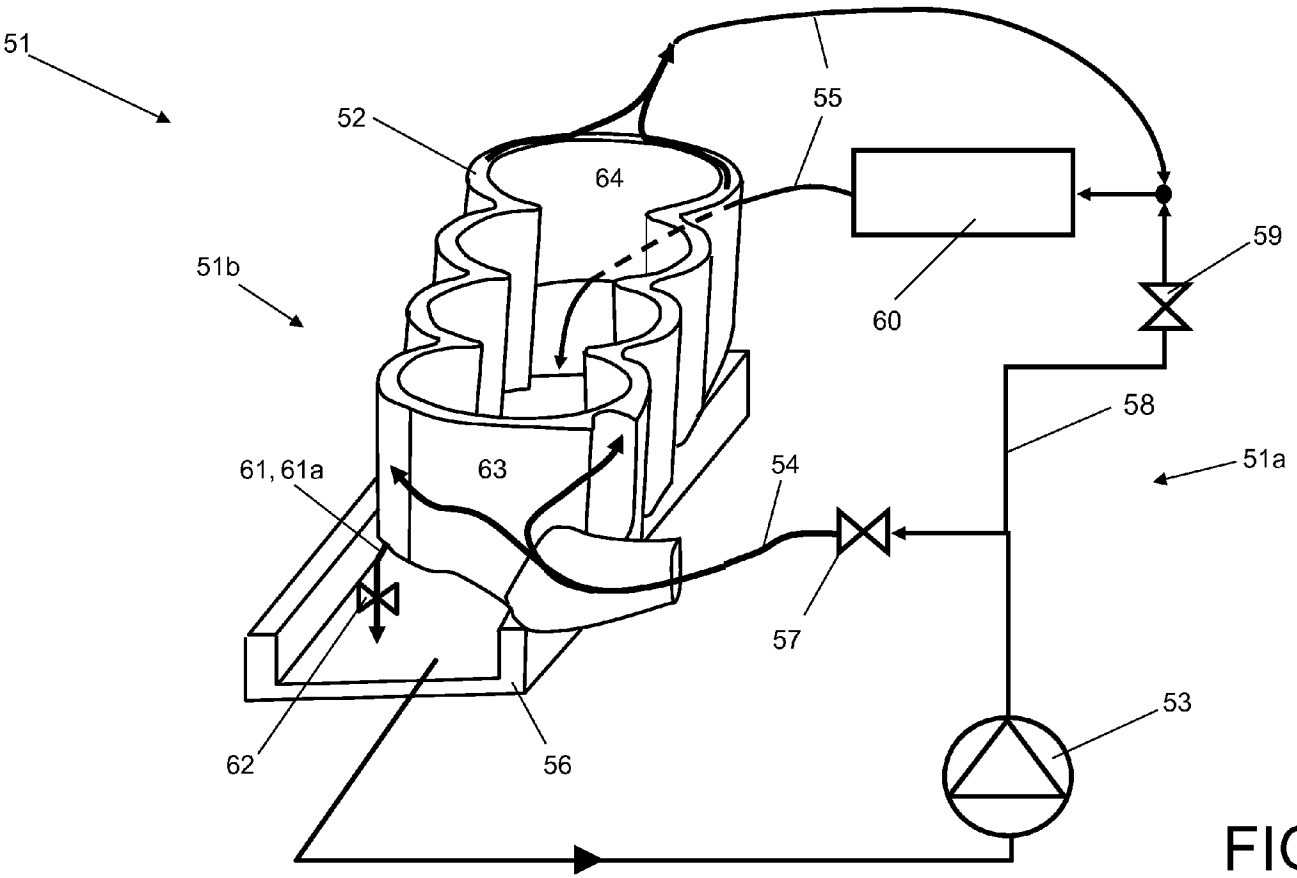
FIG. 3 shows the oil circuit of an embodiment of the present disclosure, partially in schematic form and partially in perspective.

FIG. 3 shows the oil circuit 51 of a first embodiment of the internal combustion engine, generally referred to in FIG. 2 as 272, partially in schematic form and partially in perspective, comprising not only the oil supply 51*a* for the internal combustion engine but also the oil cooling system 51*b* of the cylinder block. In the present case, the internal combustion engine is a four-cylinder in-line engine.

The cylinder block, omitted here, shown in FIG. 2, which includes the upper crankcase half, is fitted with an integrated coolant jacket 52 to form an oil cooling system 51*b*. On the inlet side 63, coolant jacket 52 is supplied, via a supply line 54, with oil stemming from an oil sump 56 by means of a pump 53. The oil sump 56 is used to collect and store the oil and is a non limiting example of an oil sump 232 shown in FIG. 2. On the outlet side 64, the coolant jacket 52 is likewise connected, via a return line 55, to the oil sump 56, thus forming an oil circuit 51, in which consuming units 60, which are also supplied with oil by oil supply system 51*a*, are also arranged.

The delivery of oil to the coolant jacket 52 of the cylinder block can be prevented by closing block coolant control valve 57 arranged in the supply line 54, and the pump 53 supplies the oil consuming units 60 with oil while bypassing the cylinder block via bypass line 58. For this purpose, the block bypass valve 59 provided in the bypass line 58 has to be opened and oil pump 53 supplies oil to one or more oil consuming units 60 provided in an oil circuit 52 while bypassing the cylinder block (shown in FIG. 2, as 226) in order to avoid delivery of oil to the at least one coolant jacket 52.

In order to drain oil from the coolant jacket 52, a drain passage line 61 is provided. To control the quantity of oil released, a shutoff element 62 is provided in the drain passage line 61. At least one additional gravity-fed drain passage line 61*a* can be used to release oil under the force of gravity, wherein additional gravity-fed drain passage line 61*a* connects the cylinder jacket 52 to the oil sump without connecting to any other oil passages. In the present figure drain passage line 61 and additional gravity-fed drain passage line 61*a* are substantially the same.

Additional variations of oil circuit 51 exist. In one example block bypass valve 59 and block coolant control valve 57 could be replaced by thermostats that would not require input from engine controller 248. Additional gravity-fed drain passage line 61*a* may be a permanently open line, which has a diameter D of D<2 mm, or of D<3 mm to allow drainage of oil of particular viscosity following engine shut off. In this variation, after engine shut off block coolant control valve 57 is closed, permanently open additional gravity-fed drain passage line 61*a* will allow oil to drain out of cooling jacket 52 reducing the cooling capacity and hence shortening the warm-up phase of the internal combustion engine when the engine is restarted. In another variation shut off element 62 could be a check valve.

Figure 4:
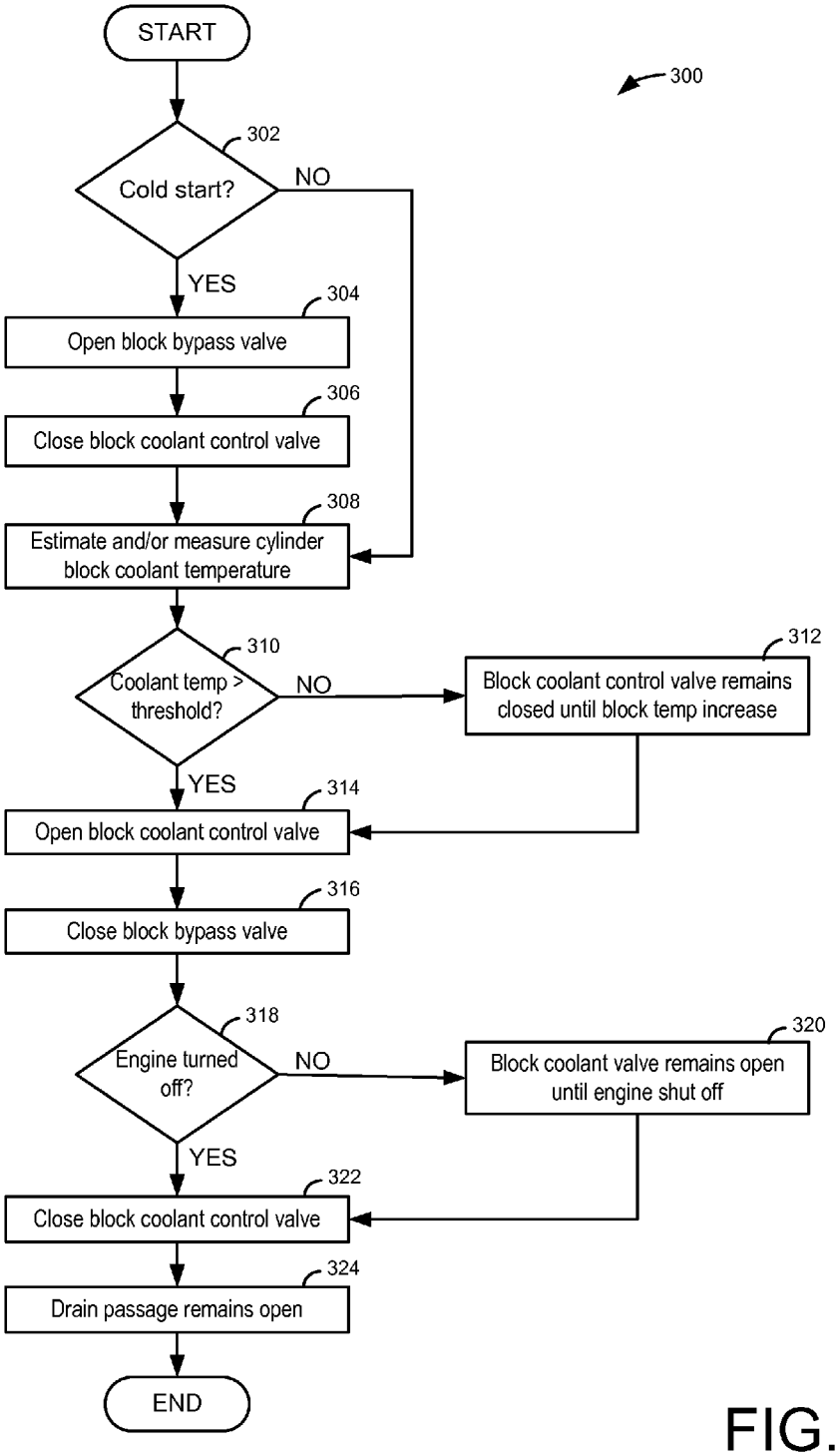
FIG. 4 shows an example method by which an engine control unit can control flow of oil in the engine such that rapid warm up occurs.

FIG. 4 depicts a method 300 to warm up a cylinder block dependent on routing of coolant oil through an oil circuit such as that described herein above and in FIG. 3. Method 300 may be carried out by controller 248 according to instructions stored thereon. At 302, it is determined whether the engine start is a cold start. If the engine start is cold (YES) than the block bypass valve 59 is opened at 304. This is immediately followed by, or simultaneous with, closing of the block coolant control valve 57 at 306. After closing of coolant control valve, or if the engine start is not cold, (NO) at 302, the block coolant temperature is estimated and/or measured at 308. Estimates of block coolant temperature can be dependent on operating conditions such as load, RPM, air-fuel ratio, mass air flow and/or manifold absolute pressure. Additionally, coolant temperature sensor 246 can directly measure engine coolant temperature. If the coolant temperature is determined to be above threshold (YES) at 310, engine coolant, i.e. oil, is circulated through the cylinder coolant jacket 52 by proceeding to 314 wherein block coolant control valve 57 is open. Immediately thereafter, or simultaneously, at 316, block bypass valve 59 is closed. At 318 it is determined if the engine has been shut off. If the engine has been shut off (YES) at 318, block coolant control valve 57 closes at 320 and the drain passage 61 remains open at 324 allowing oil to drain out of the coolant jacket 52 and into oil sump 56. If the engine has not been shut off at 318 (NO), block coolant control valve 57 remains open until the engine has been shut off, at which point the block coolant control valve 57 closes at 318. The method 300 according to the disclosure then ends.

Variations to the above method may include varied diameters of drain passage 61 as discussed above herein, providing a means of selectively draining coolant oil responsive to oil viscosity which is related to its temperature. In other examples of the present disclosure additional command of coolant oil circuit valves may be enacted to further control coolant oil, and concomitantly, cylinder jacket temperature beyond an initial warm up phase. Alternatively, shut off element 62 could be controlled by engine controller 248. In an embodiment where it is advantageous to maintain the oil level in the cylinder jacket without replacing oil via oil pump 53, shut off valve 62 could be closed by the engine controller 248. Additionally, block bypass valve 59 and block coolant control valve 57 could be thermostat controlled instead of solenoid valves responsive to engine controller 248. Also, bypass controller valves 59 and 57 can be opened and closed independently of the temperature of the cylinder head coolant circuit 3.

Figure 5:
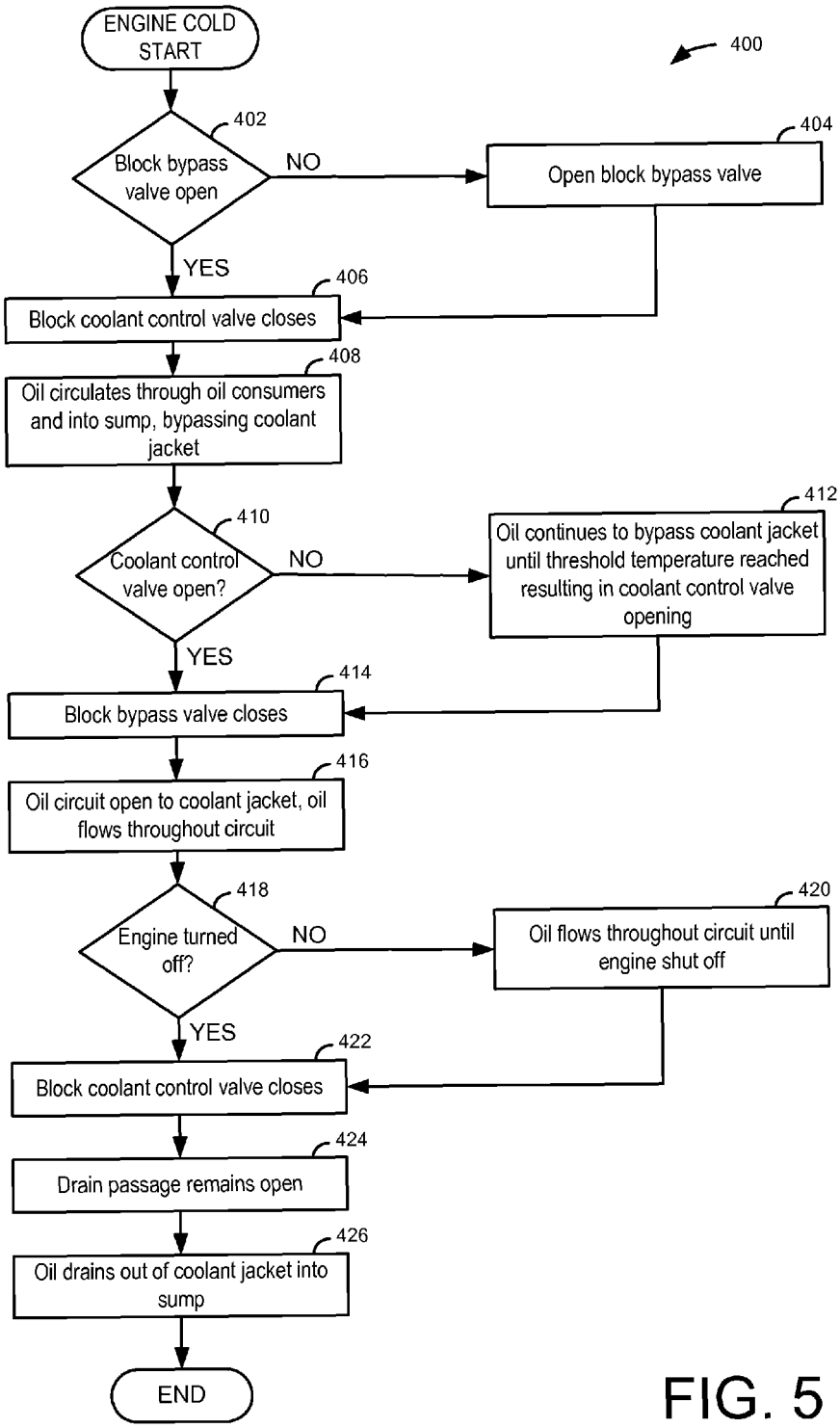
FIG. 5 shows a schematic depiction of oil flow in an oil circuit according to the method of the present disclosure.

Referring now to FIG. 5, the figure schematically depicts method 400 by which oil flows throughout oil circuit 51 depicted in FIG. 3 following the cold start of an engine. At 402 it is determined whether block bypass valve 59 is open. If at 402 block bypass valve 59 is not open (NO) it is opened at 404. If block bypass valve 59 is open (YES) at 402, or after it has been opened at 404, method 400 proceeds to 406 wherein block coolant control valve 57 closes. Following closure of block coolant control valve 57, at 408 oil circulates throughout oil consuming units 60 but bypasses coolant jacket 52. At 410 it is determined if block coolant control valve 57 is open. If block coolant control valve 57 is open (YES) method 400 proceeds to 414 where block coolant bypass valve 59 closes. If at 410, block coolant control valve 57 is not open (NO), oil will continue to bypass the coolant jacket until a threshold temperature is reached and coolant control valve 57 opens at 412. Method 400 then proceeds to 414 where block coolant bypass valve 59 closes. At 416, oil circuit 51 opens to coolant jacket 52 and oil flows throughout the circuit. At 418, it is determined whether the engine has been turned off. If the engine has not been turned off (NO), oil continues to flow throughout the circuit until the engine is shut off at 420. If the engine has been shut off at 418 (YES), or following 420, method 400 proceeds to 422 wherein block coolant control valve 57 closes. At 424 drain passage 61 remains open. At 426 oil drains out of coolant jacket 52 through drain passage 61 into the oil sump 56. Method 400 according to the present disclosure there ends.

Method 400 depicts the flow of oil through circuit 51 following an engine cold start which expedites warm up of engine block 226. The valves referred to in method 400 of FIG. 5 can be controlled by engine controller 248 according to the method depicted in FIG. 4. If the engine is not started cold, method 400 may not apply. According to the present disclosure following engine shut off some of the oil is released via drain passage 61. This has the effect of reducing the cooling capacity of the oil cooling system when the internal combustion engine is restarted, and thus shortening the warm-up phase of the internal combustion engine.

Variations on method 400 may occur based on additional requirements for controlling of coolant oil and coolant jacket temperature as discussed above. For example, block coolant control valve 57 may be closed again after the engine has been running and reached a threshold temperature if there is an additional requirement for reduced cooling capacity in coolant jacket 52 beyond the initial warm up phase. In another example, shut off element 62 may not be continuously open and may require additional inputs for control based on engine operating conditions. Additionally drain passage 61 may contain an additional gravity-fed drain passage line 61*a* with predetermined diameter which allows drainage of oil only at a specific viscosity as described previously herein.

The method of the previous disclosure as described allows for heating a cylinder block of the engine by bypassing coolant around the cylinder block during an engine cold start. When the cylinder block reaches a threshold temperature then coolant is routed through a coolant jacket of the cylinder block thus providing adequate cooling for both the cylinder jacket and other oil consuming units. Following an engine shut-off event, coolant is routed from the coolant jacket to an oil sump reducing the cooling capacity of the cylinder jacket upon a subsequent engine restart. The method is achieved by opening at least one bypass controller valve in an oil circuit following an engine cold start, then closing the bypass controller valve in the oil circuit responsive to a cylinder block of the engine reaching a threshold temperature.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine comprising:

starting the engine with a cylinder jacket drained of oil;

upon an engine cold start, opening a bypass valve in a bypass line of an oil circuit to bypass the cylinder jacket;

closing a coolant control valve in a supply line of an oil circuit connecting an oil pump to the cylinder jacket; and closing the bypass valve responsive to a cylinder block temperature reaching a threshold temperature.

2. The method as claimed in claim 1, further comprising routing oil through the oil circuit via the oil pump and the bypass line to one or more oil consuming units excluding the cylinder jacket when the coolant control valve is closed.

3. The method as claimed in claim 2, further comprising routing oil through the oil circuit via the oil pump to one or more oil consuming units via the bypass line and the cylinder jacket via the supply line when the coolant control valve is open.

4. The method as claimed in claim 1, wherein the temperature is estimated dependent on operating conditions including air-fuel ratio, mass air flow and/or manifold absolute pressure.

5. The method as claimed in claim 1, further comprising routing coolant through a cylinder head water coolant circuit separate from the oil circuit.

6. The method as claimed in claim 5, wherein the bypass valve is opened and closed independently of a temperature of the cylinder head water coolant circuit.

7. The method as claimed in claim 5, wherein the coolant control valve is opened and closed independently of a temperature of the cylinder head water coolant circuit.

8. The method as claimed in claim 1, further comprising opening the coolant control valve responsive to the cylinder block temperature reaching the temperature threshold.

9. The method as claimed in claim 7, further comprising closing the coolant control valve responsive to engine shut off.

* * * * *